US005354042A

United States Patent [19]

Coombs

[11] Patent Number: 5,354,042

[45] Date of Patent: Oct. 11, 1994

[54] IN-BIN STAPLING SORTER WITH VARIABLE POWER STAPLER

[75] Inventor: Peter M. Coombs, Tustin, Calif.

[73] Assignee: Gradco (Japan) Ltd., Tokyo, Japan

[21] Appl. No.: 16,450

[22] Filed: Feb. 11, 1993

[51] Int. Cl.[5] ..... B31B 1/70; B27F 7/36; B25C 1/06

[52] U.S. Cl. ..... 270/53; 227/5

[58] Field of Search ..... 355/324; 270/53, 37; 227/1, 3, 5

[56] References Cited

U.S. PATENT DOCUMENTS

| | | | |
|---|---|---|---|
| 3,278,101 | 10/1966 | Hatazaki | 227/2 |
| 4,181,248 | 1/1980 | Spehrley, Jr. | 227/5 X |
| 4,421,264 | 12/1983 | Arter et al. | 228/2 |
| 4,452,525 | 6/1984 | Ogura | 355/14 R |
| 5,161,724 | 11/1992 | Radtke et al. | 227/1 |
| 5,187,534 | 2/1993 | Iwata et al. | 270/53 X |
| 5,230,457 | 7/1993 | Hiroi et al. | 227/2 |

FOREIGN PATENT DOCUMENTS

| | | | |
|---|---|---|---|
| 404118295 | 4/1992 | Japan | 270/53 |
| 404255396 | 9/1992 | Japan | 270/53 |

*Primary Examiner*—Edward K. Look
*Assistant Examiner*—John Ryznic
*Attorney, Agent, or Firm*—Newton H. Lee, Jr.

[57] ABSTRACT

Sheet printing and collating apparatus includes a sheet sorter which has a stapler for stapling sets of sheets in the sorter bins. The stapler is actuated by an electric motor to which the applied power is varied depending upon the number of sheets of paper in the sets and therefore, the thickness of the sets to be stapled.

Sheets entering the sorter trays are counted and information as to the number of sheets per set is supplied to the microprocessor unit which controls the stapler to supply control signals to a variable power supply to the stapler motor so that the motor power applied to the stapler increases as the number of sheets per set increases.

3 Claims, 4 Drawing Sheets

IN-BIN STAPLING SORTER WITH VARIABLE POWER STAPLER

BACKGROUND OF THE INVENTION

Sorters have evolved for use with office copiers and printers for sorting sheets into collated sets or separating sets of sheets or jobs and the sets are stapled together in the sorter trays. An example is shown in my U.S. patent application Ser. No. 848,489, filed Mar. 9, 1992, co-owned herewith.

The trays may also be shifted to a stapler, for example, as shown in Kramer et al U.S. Pat. No. 4,925,171; the sets may be partially removed from the trays, stapled and returned to the trays as disclosed in Lawrence U.S. application Ser. No. 730,746, filed Jul. 16, 1991, co-owned herewith, or the sets may be transferred to a stapler as in Crammer U.S. Pat. No. 4,361,373.

In all of these devices the stapling function creates an objectionable noise. Moreover, the stapler, in use is adapted to drive a staple into a set of sheets of some maximum number of sheets or thickness, depending upon the capacity of the sorter and the copier or printer with which the sorter is employed and the stapler construction.

As a result, the force applied to cause the movement of the stapler hammer or driver towards the stapler anvil and the resultant noise caused by the inserting and clinching of the staple is at the same high level, regardless of the number of sheets actually in the set of sheets to which the staple is being applied. When such stapling noise is repeated, numerous times, as staples are applied to, say, twenty sets, at a number of, say, three locations, the distraction of workers by the driving of sixty staples may be serious.

Just as importantly, the noise may exceed the permissible office noise under some regulations controlling office environment.

It is also known, as disclosed in Ishigino et al U.S. Pat. No. 4,864,350, Sep. 5, 1989, for example, that sheets entering a sorter may be counted, whereby the stapler may be disabled if the count is outside of a range of sheets, say, a range between 1 and 25, so that single sheets or sets of sheets exceeding the capacity of the stapler can not be stapled.

SUMMARY OF THE INVENTION

The present invention has as an objective reduction of the noise caused by the stapling of sets of sheets in sorters used in the office environment by reduction of the force applied as the staples are being driven through the sheets of paper against an anvil and clinched if the full force is not required.

More particularly the invention contemplates stapling utilizing a stapling impact force which is reduced from a maximum when the set of sheets is thick to a minimum when the set of sheets is thin depending upon the number of sheets per set.

In the case of the typical sorter of the type here involved, the copier or printer and the sorter are equipped to exchange information with the host machine or react to information or conditions related to the number of sets of a given document to be produced and sorted in the trays, i.e., the number of trays into which sheets are fed and collated or into which collated sets are fed, and also as to the number of sheets in a set. Thus, a sorter will collect the output, say, from a copier, of the number of sets established by a selector on the copier. Each set, moreover, will contain the number of sheets depending upon the sheets in the original being copied. The sorter may detect the entry of each sheet in each set and a new sorting cycle begins with each new original copied. Therefore, the number of sorting cycles represents the number of sheets in a tray.

The present invention contemplates varying the power of the stapler motor as a function of the number of sheets in the set of documents to be stapled. The power of the motor depends upon the applied electrical power.

In the stapling process, the maximum power is required to drive a staple through the set of sheets of maximum thickness and clinch the ends of the staple by the stapler anvil. However, it has been determined that the noise generated by the stapling is at a minimum due to the absorption of power by the paper in the set as the staple is driven, the paper compressed and the staple ends clinched. On the other hand, as the thickness of the set is reduced down to a minimum of say 2 sheets, in normal stapling with the same applied power, the paper provides a minimum of force absorption as the staple is driven and crimped, and therefore, the noise level is measurably higher.

Therefore, in accordance with the invention the applied power for the stapler drive motor is varied depending upon the number of sheets in the sets of sheets and related thickness of the set which determines the extent to which the impact forces and noise are absorbed or dissipated.

The force required to properly drive and clinch the staple against the anvil of a stapler for binding the set of sheets depends upon the thickness of the set of sheets. In any given case, the thickness of the set depends upon the number of sheets and the weight and thickness of the paper. Thus, 20 sheets of 24 pound paper constitute a thicker set than the same number of sheets of 20 pound or 16 pound paper. Thus, by counting the sheets of paper and based upon the known paper weight, the invention enables the application of only the force necessary to drive and clinch the staple in sets of different thickness depending upon the count of the sheets per set.

DESCRIPTION OF THE PREFERRED EMBODIMENT

Figure 1:
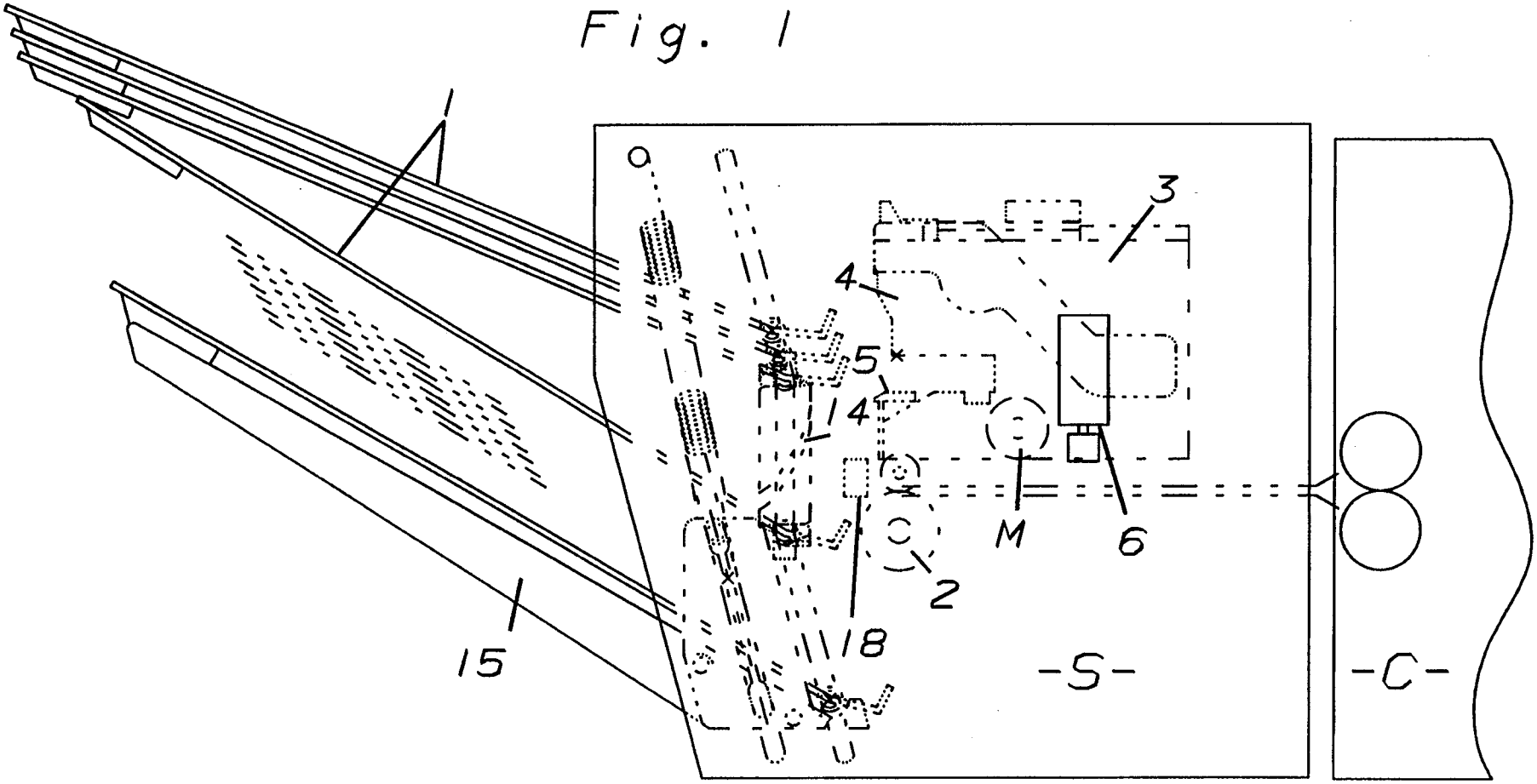
FIG. 1 is a side elevation of one form of in-bin stapling sorter useful in the practice of the invention.

Referring first to FIG. 1 a moving bin sorter S is illustrated adapted to receive sheets from a copier or printer. The sorter is an in-bin stapling sorter as disclosed in my pending application Ser. No. 848,489, referred to above to which reference may be had for the details of an exemplary sorter with which the present invention is useful. Other stapling sorters of the various other constructions illustrated in the extant U.S. patents referred to above, or otherwise, may also advantageously employ the invention to control the stapler motor power for noise reduction.

The essence of the present invention resides in controlling the stapler motor to reduce the power applied to the motor below maximum power necessary to clinch a staple in a set of sheets containing the largest number of sheets or set thickness for which the stapler construction is designed, when the set contains fewer sheets than such maximum number, resulting in a reduction in force and noise as the staple is applied.

The sorter S shown is of the moving bin type. A plurality of sheet receiving trays are adapted to receive sheets from a copier or printer C in a number selected by the user of the copier or printer. The sheets are transported to the sorter trays by infeed rolls 2. A stapler 3 driven by an electric motor M has a body 4 for containing a supply of staples which are driven through the set of sheets by a stapler hammer and crimped against the stapler anvil 5, as customary.

As seen in FIG. 1, the stapler is in a retracted or out of the way position so as not to interfere with the feeding of paper sheets to the sorter trays by the infeed rolls 2. However, as seen in FIG. 2, the stapler has been shifted by a motor and gear drive 6 to a position at which a set of sheets 7 are disposed at one edge in the throat 8 of the stapler to receive a staple 9 driven by the usual hammer, through the set of sheets 7 and crimped or clinched against the anvil 5.

The illustrated sorter is of the moving bin type wherein the ends of tray 1 adjacent to the sheet infeed 2 are moved vertically between positions above and below the sheet entry position by a pair of rotary cams 10, one of which is here shown as a spiral cam, adapted to be driven in opposite directions through one revolution to move the trays to positions above and below the cams and to form an enlarged sheet entry space into which sheets are fed by the infeed 2, as customary in such sorters. The tray ends have trunnions or cam followers 12 slidably disposed in guide slots 13 in the sorter frame structure and engageable in the spiral cam track 14 to move the trays. In the form shown, the trays are supported one on the other on a bottom tray support 15 adapted to move vertically at its inner end in a guide slot 16. A tension spring 17 is connected between the frame structure and the bottom tray support 15 to apply a lifting force which urges the trays below the cam and the bottom tray support upwardly. The remote ends of the trays are pivotally and freely supported one on the other and on the tray support to permit the trays to be opened by the cam as the trays move upwardly and downwardly during sorting operations.

Such sorters have the usual control systems which enable selection of the number of sets of sheets to be accumulated in the respective trays. Such control systems include a sheet sensor 18 located so as to detect the passage of a sheet from the infeed into the trays, and to send a control signal to the system causing the cam drive to operate for shifting a selected number of bins sequentially in the direction necessary to receive the sheets in a selected number of trays to provide sets of sheets of a selected number of sheets per set.

Figure 2:
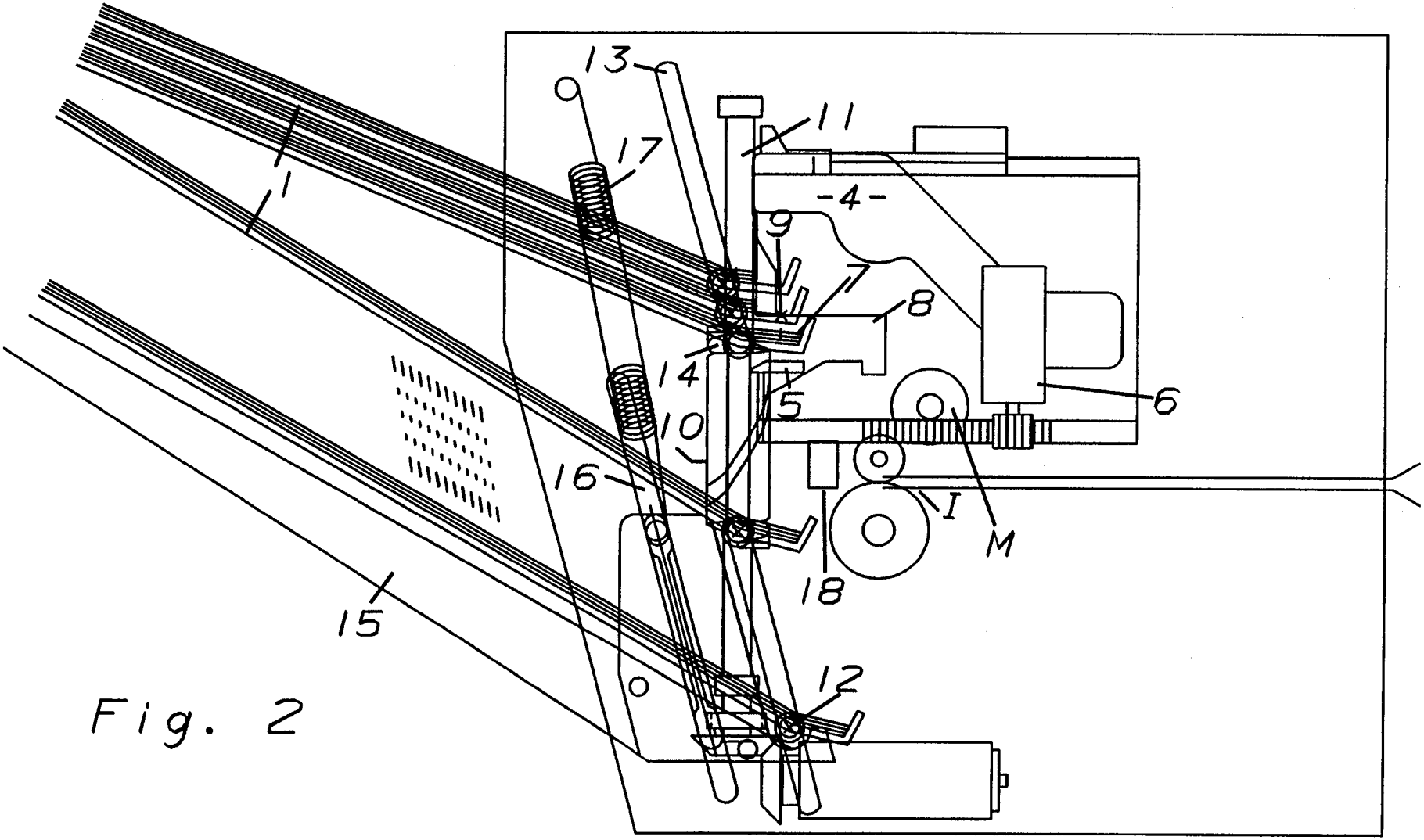
FIG. 2 is a vertical section showing the stapler of the sorter of FIG. 1 in a stapling position.

When the sorting operation has been completed, in the illustrated case, the stapler is automatically and alternately moved between the non-stapling position of FIG. 1 to the stapling position of FIG. 2, as the trays are moved sequentially upwardly and stopped at the stapling position of FIG. 2 at which a staple is to be driven through the set of sheets and clinched against the anvil 5.

The present invention recognizes a) that the force required to drive a staple through a set of sheets and clinch the ends of the staple securely at the underside of a set of sheets which is thick, say 25 sheets, is a force greater than is necessary to perform the stapling function if the set of sheets is thin, say 2 sheets, and b) that the noise caused by stapling is directly related to the stapling force applied.

Figure 3:
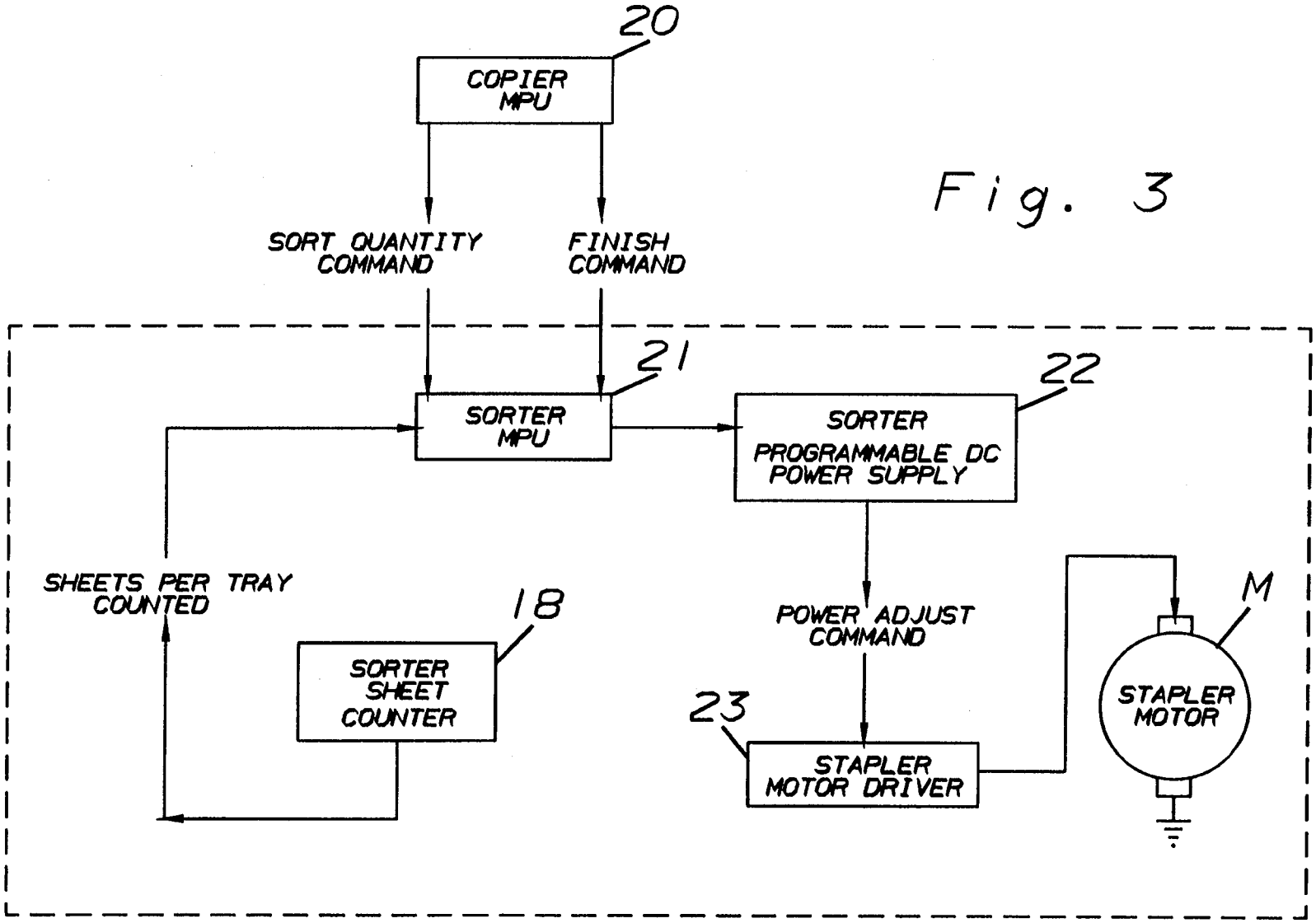
FIG. 3 is a diagram showing the control system for the sorter of FIGS. 1 and 2.

Therefore, referring to FIG. 3, means are provided to apply more or less stapling force depending upon the number of sheets or thickness of a set of sheets to be stapled.

As seen in FIG. 3 an interface is provided between the microprocessor unit 20 (MPU) of the copier and the microprocessor unit 21 (MPU) of the sorter, so that the user selects at the copier the number of sets of sheets or copies of an original to be produced by applying to the CPU 21 of the sorter a "Sort Quantity Command" from the copier. It should be understood that in some sorters, the sorter MPU may be programmed to directly receive a sort quantity command independently of the copier, when there is no direct copier-sorter interface.

The optical sensor 18 counts the sheets per tray as well as performing the function of detecting the passage of sheets into each tray to cause the sorter MPU 21 to activate the tray shifting mechanism previously described. Separate detectors may be employed, if desired, one detector to detect the passage of sheets into the trays to cause the trays to shift and another separate detector 18 to count the sheets entering each tray.

The purpose of the counting function in either case is to enable the sorter MPU 21 to control the power applied to the stapler motor M during stapling operations, as best understood by reference to FIG. 3. In the case that the copier MPU 20 is adapted to supply a stapling or finishing mode instruction "Finish Command" to the sorter MPU 21, finishing is initiated by the user of the copier by pressing the appropriate switch, but in another case the staple or finish command may be provided by a switch on the sorter when the copier and sorter MPU's are not interfaced.

The sorter MPU 21 is also adapted to provide a "Power Adjust Command" to a sorter programmable DC power supply unit 22 which causes the level of power supplied to motor M through the motor drive 23 to be adjusted as a function of the "Sheets Per Tray Counted" signal provided to the sorter MPU 21 from sheet counter-detector 18.

Since the force by which staples are applied to the sets of sheets in the trays is a function of the level of electric power supplied to stapler motor M, the programmable power supply 22 is capable of increasing or decreasing the applied motor power depending upon the number of sheets counted by the sensor 18 under the control of the sorter CPU 21 which is programmed responsive to the sheets per tray counted signal from sensor 18.

Figure 4:
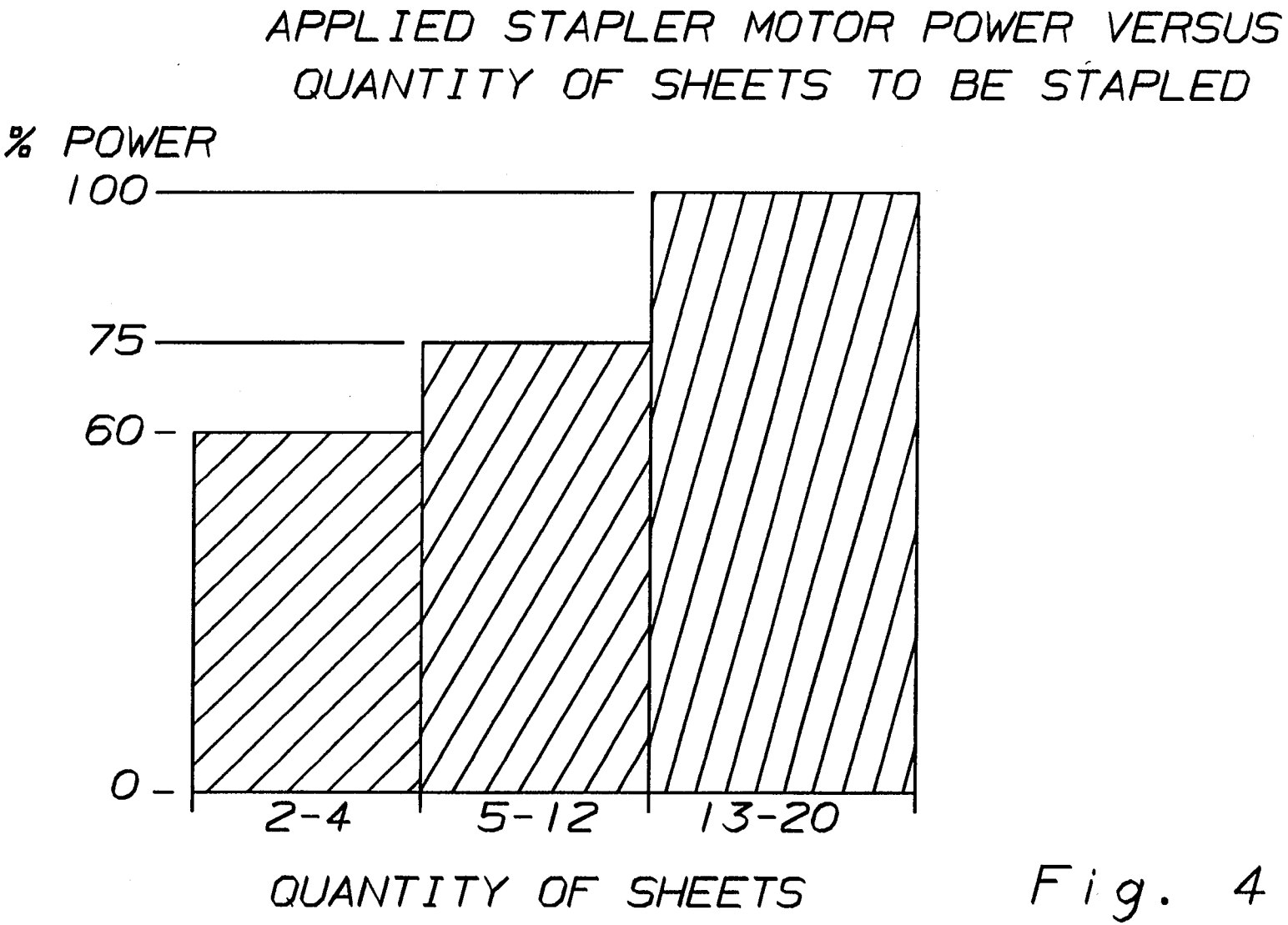
FIG. 4 is a power versus sheet quantity chart illustrative of the function of the invention.

The programmable motor power supply 22 may be programmed, for example, as seen in FIG. 4. Assuming that the full motor force is desired or necessary to staple 13 to 20 sheets, the power supply provides 100% of the power when the sensor 18 counts 13–20 sheets per tray. However, when the quantity of sheets per tray counted by sensor 18 is less than 13, the level of power to the motor M may be reduced by the programmable power supply 22. Thus, as seen in FIG. 4, for example, the stapler motor power may be reduced to 75% of full power when 5–12 sheets per tray are counted and to 60% of full power when less than 5 sheets, say, 2–4 sheets are in each set to be stapled.

With such an adjustable power supply it will be recognized that the noise caused by automatic, in bin stapling of sets is reduced when the sets are so thin as to require less motor power to effect stapling. Since, the thickness of the sets of sheets primarily determines the necessary stapler motor power to drive the stapler through the set of sheets and clinch the ends of the staple between the anvil and the bottom sheet, the programmable power supply 22 can be adjusted to require full stapler motor power when a given number of sheets of heavy paper are to be stapled, but adjusted to provide less stapler motor power when the same number of sheets of paper of a lighter weight and of less thickness are being stapled.

From the foregoing, it will be understood that the invention provides for overall noise reduction in stapling sorters in the case that full stapler power is not required to drive and clinch staples in a set of sheets of less than maximum thickness or number of sheets.

I claim:

1. In an in-bin stapling sorter comprising a plurality of trays for receiving sets of sheets, a stapler, means for relatively moving the stapler and the sets of sheets between a non-stapling and a stapling position, and drive means for said stapler to insert a staple in a set of sheets in said stapling position, the improvement wherein said drive means for said stapler includes an electric motor and control means for said motor for selectively energizing said motor to operate said stapler at higher or lower power depending upon the thickness of sets of sheets, said control means including means for counting the sheets in said sets to selectively energize said motor depending upon the number of sheets constituting a set.

2. In a sorter as defined in claim 1, said motor being a DC motor and said control means includes a motor controller responsive to the thickness of sets of sheets to adjust the power supplied to said motor.

3. In a sorter as defined in claim 1, said control means including means for counting the sheets in said sets in a plurality of stages of a predetermined range of numbers of sheets to selectively energize said motor with power in stages depending upon the range of numbers of sheets in said sets.

* * * * *